US010245604B2

(12) United States Patent
Foreman

(10) Patent No.: US 10,245,604 B2
(45) Date of Patent: Apr. 2, 2019

(54) APPARATUS AND METHOD FOR DISPENSING LIQUEFIED FLUID

(71) Applicant: BREVDA INC., Austin, TX (US)

(72) Inventor: Doug Foreman, Austin, TX (US)

(73) Assignee: BREVDA INC., Austin, TX (US)

( * ) Notice: Subject to any disclaimer, the term of this patent is extended or adjusted under 35 U.S.C. 154(b) by 151 days.

(21) Appl. No.: 14/984,944

(22) Filed: Dec. 30, 2015

(65) Prior Publication Data

US 2016/0184848 A1 Jun. 30, 2016

Related U.S. Application Data

(60) Provisional application No. 62/098,128, filed on Dec. 30, 2014.

(51) Int. Cl.

| | |
|---|---|
| ***B05B 9/00*** | (2006.01) |
| ***B05C 5/00*** | (2006.01) |
| ***B05C 17/005*** | (2006.01) |
| ***B05B 7/06*** | (2006.01) |
| ***B05B 7/16*** | (2006.01) |
| *B05B 11/00* | (2006.01) |

(52) U.S. Cl.

CPC ..... *B05B 9/002* (2013.01); *B05B 7/065* (2013.01); *B05B 7/1666* (2013.01); *B05B 7/1693* (2013.01); *B05C 5/001* (2013.01); *B05C 17/00526* (2013.01); *B05B 7/1606* (2013.01); *B05B 11/00* (2013.01); *B05B 11/0002* (2013.01)

(58) Field of Classification Search

CPC ..... B05B 9/002; B05B 7/1693; B05B 7/065; B05B 7/1666; B05B 7/1606; B05B 11/00; B05B 11/0002; B05C 9/0426; B05C 15/008; B05C 11/101; B05C 5/00; B05C 5/001; B05C 17/00523; B05C 17/00526; B05C 17/00546; B05C 17/00553; A47G 19/14; A47J 31/446; A47J 37/1223; A23C 15/02

USPC ..... 392/477, 495; 239/128–139; 118/13, 24

See application file for complete search history.

(56) References Cited

U.S. PATENT DOCUMENTS

| | | | | |
|---|---|---|---|---|
| 467,727 A | | 1/1892 | Schon | |
| 3,783,820 A | * | 1/1974 | Hautly | A23L 7/191 118/19 |
| 4,096,258 A | | 6/1978 | Hanson | |

(Continued)

FOREIGN PATENT DOCUMENTS

| | | | |
|---|---|---|---|
| EP | 2524603 A1 | * | 11/2012 |
| EP | 2805619 A1 | | 11/2014 |

(Continued)

OTHER PUBLICATIONS

International Search Report for PCT/US2015/068155, dated Apr. 6, 2016, 1 page.

*Primary Examiner* — Laura Edwards

(74) *Attorney, Agent, or Firm* — Abel Law Group, LLP

(57) ABSTRACT

An apparatus for dispensing a liquefied fluid including a housing, a main reservoir at least partially disposed within the housing, wherein the main reservoir is adapted to receive a substance, a heating element positioned to melt the substance into liquefied fluid, a second reservoir in fluid communication with the main reservoir, and a nozzle in fluid communication with the second reservoir, wherein the substance is dispensable from the nozzle as liquefied fluid.

18 Claims, 10 Drawing Sheets

(56) References Cited

U.S. PATENT DOCUMENTS

| | | | | |
|---|---|---|---|---|
| 4,477,023 | A | 10/1984 | Gates | |
| 4,828,146 | A | 5/1989 | Stein | |
| 5,375,766 | A * | 12/1994 | Sweeney | B05B 7/1606 219/230 |
| 5,455,055 | A | 10/1995 | Stoltz | |
| 5,680,961 | A * | 10/1997 | Boccagno | B05C 11/1042 219/421 |
| 6,113,970 | A | 9/2000 | Rainey et al. | |
| 7,005,615 | B2 | 2/2006 | Thomas | |
| 7,315,691 | B1 | 1/2008 | Palkie et al. | |
| 7,326,884 | B1 | 2/2008 | Anderson et al. | |
| 8,056,764 | B2 | 11/2011 | Paasch et al. | |
| 8,329,245 | B2 | 12/2012 | Landon | |
| 8,642,105 | B2 | 2/2014 | Soerensen et al. | |
| 2010/0055309 | A1* | 3/2010 | Frey | B05C 5/001 427/239 |
| 2012/0090813 | A1* | 4/2012 | Palumbo | A47J 27/21166 165/56 |
| 2014/0030414 | A1 | 1/2014 | Wehrli | |

FOREIGN PATENT DOCUMENTS

| | | | |
|---|---|---|---|
| WO | 2010094945 | A2 | 8/2010 |
| WO | 2016109729 | A1 | 7/2016 |

* cited by examiner

APPARATUS AND METHOD FOR DISPENSING LIQUEFIED FLUID

CROSS-REFERENCE TO RELATED APPLICATION(S)

This application claims priority under 35 U.S.C. § 119(e) to U.S. Patent Application No. 62/098,128 entitled "APPARATUS AND METHOD FOR DISPENSING LIQUEFIED FLUID," by Doug Foreman, filed Dec. 30, 2014, which is assigned to the current assignee hereof and incorporated herein by reference in its entirety.

FIELD OF THE DISCLOSURE

The present disclosure relates to apparatuses and methods for dispensing liquefied fluid.

RELATED ART

Preparation of consumable food often benefits from use of a liquefied fluid, such as an oleo based product, a water-in-oil emulsion, lecithin, or another similar product. However, use of such fluids is limited by composition characteristics of the fluids and available deployment devices capable of readily delivering said fluids.

Industries continue to demand improved apparatuses and methods for dispensing liquefied fluids.

BRIEF DESCRIPTION OF THE DRAWINGS

Embodiments are illustrated by way of example and are not intended to be limited in the accompanying figures.

Figure 1:
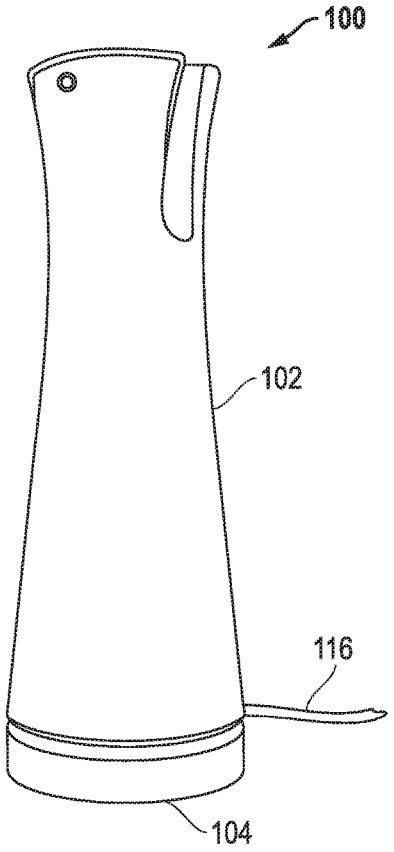
FIG. 1 includes a perspective view of an apparatus including a housing and a base in accordance with an embodiment.

Skilled artisans appreciate that elements in the figures are illustrated for simplicity and clarity and have not necessarily been drawn to scale. For example, the dimensions of some of the elements in the figures may be exaggerated relative to other elements to help improve understanding of embodiments of the invention. In addition, certain structures, such as electrical wirings and connections, have been omitted from the figures for the sake of clarity.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the fluid dispensing arts.

In accordance with one or more embodiments described herein, an apparatus for dispensing a liquefied fluid can include a housing, a main reservoir at least partially disposed within the housing and adapted to receive a substance, and a heating element positioned to melt the substance into liquefied fluid. In particular embodiments, a second reservoir may be in fluid communication with the main reservoir. In other embodiments, a nozzle may be in fluid communication with the second reservoir and may be adapted to dispense liquefied fluid.

In accordance with one or more embodiment described herein, a method of dispensing a liquefied fluid can include providing an apparatus having a housing, a main reservoir, a heating element, and a nozzle. In an embodiment, the apparatus is engageable with a base. The method may further include removing the apparatus from the base; engaging the heating element such that a substance disposed in the main reservoir forms liquefied fluid; and selectively engaging a control element on the apparatus to dispense the liquefied fluid from the nozzle.

Referring initially to FIG. 1, an apparatus 100 in accordance with one or more embodiments described herein can generally include a housing 102 adapted to dispense a quantity of liquefied fluid. In an embodiment, the housing 102 can be removably engageable with a base 104. In an embodiment, the base 104 can rest below the housing 102. In a further embodiment, the base 104 can be disposed below the housing 102 such that no portion of the base 104 is disposed radially outside of the housing 102. That is, from a top view, the base 104 may not be visible from under a perimeter of the housing 102.

Figure 2:
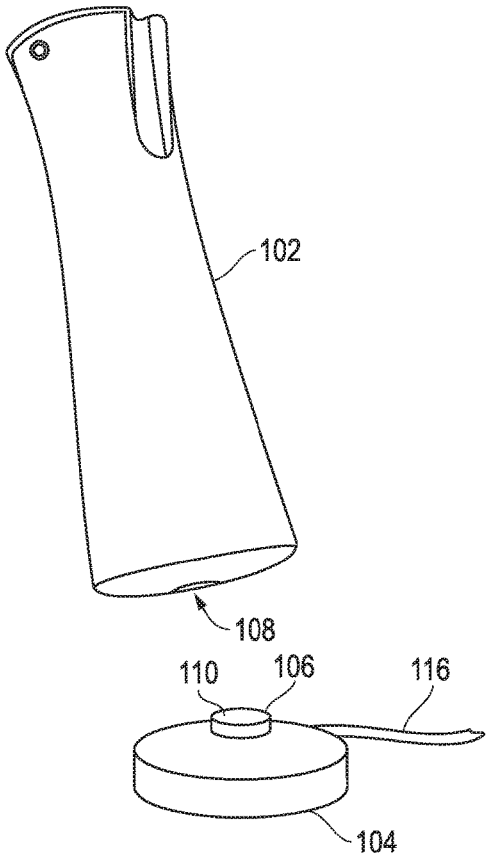
FIG. 2 includes a perspective view of the apparatus of FIG. 1 in accordance with an embodiment.

FIG. 2 includes a perspective view of the housing 102 as removed from the base 104. As illustrated, the base 104 can include an alignment feature 106 adapted to align with a complementary alignment feature 108 of the housing 102. In an embodiment, the alignment feature 106 can include a post or a recess while the complementary alignment feature 108 can include the other of a post or recess. The post can have an outer diameter less than the inner diameter of the recess. In an embodiment, the post or recess can be frustoconical, optionally including a rounded or beveled apex.

In an embodiment, the base 104 can have a maximum height, as measured from a lowest vertical elevation to a highest vertical elevation, of less than 6 inches, such as less than 5 inches, less than 4 inches, less than 3 inches, or even less than 2 inches. This may reduce overall height when the base 104 and housing 102 are engaged.

Figure 3:
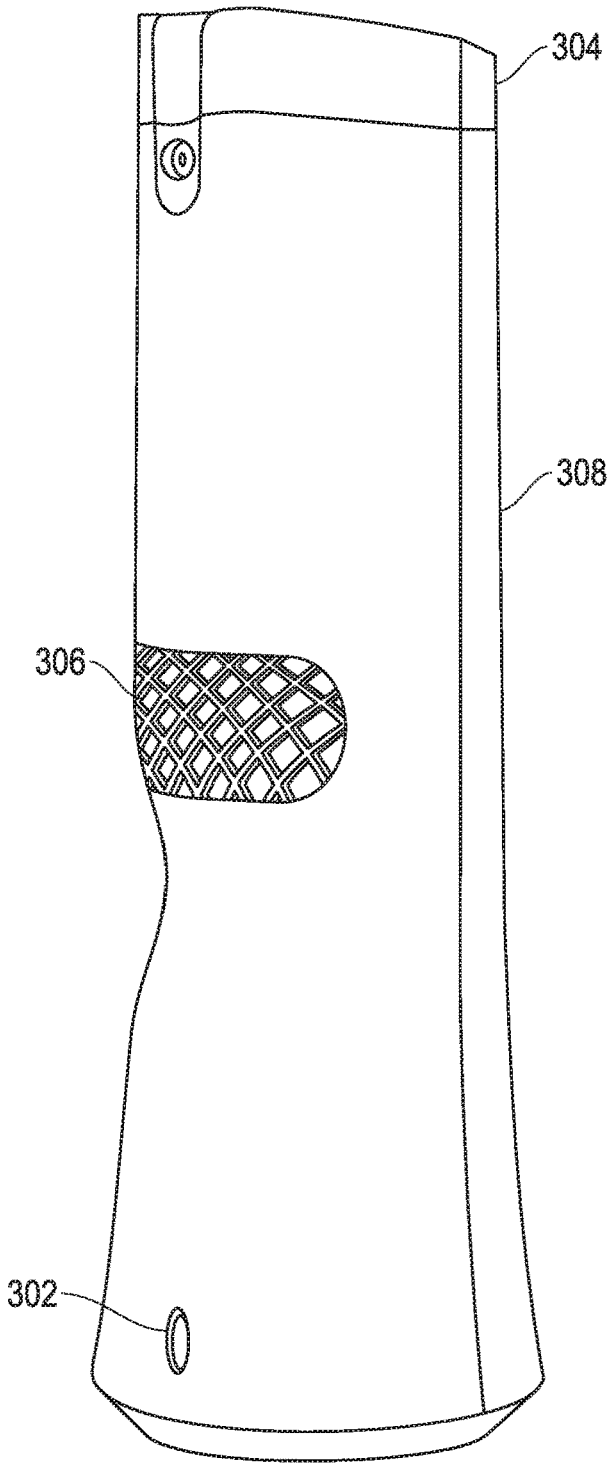
FIG. 3 includes a perspective view of an apparatus including a body engaged with a cap in accordance with an embodiment.

In an embodiment, the base 104 can include at least one electrical contact 110 and the housing 102 can include at least one electrical contact 112 (FIG. 3). In a particular embodiment, the electrical contacts 110 and 112 may be visible. For example, either of the electrical contacts 110 or 112 can include an exposed metal contact. In another embodiment, the electrical contacts 110 may be covered, recessed, or otherwise not differentiable from the base 104 or housing 102.

Upon engagement between the housing 102 and base 104, the electrical contacts 110 and 112 may electrically couple together so as to transfer an electrical current to the housing 102. A power source, discussed in greater detail below, disposed in the housing 102 may be electrically coupled to the at least one electrical contact 112 and receive the electrical current. Skilled artisans will recognize that the electrical contacts 110 and 112 on the base 104 and housing 102 may be disposed at any suitable location therebetween and are not limited to the alignment features 106 and 108 as illustrated.

The base 104 may include an electrical cord 116 extending therefrom and engageable with a power outlet (not illustrated). In an embodiment, the electrical cord 116 may be in direct electrical communication with the electrical contact 110. In a further embodiment, one or more electrical elements may be disposed between the electrical cord 116 and the electrical contact 110, such as for example, a converter, one or more transistors, capacitors, or other current or voltage manipulating devices. The electrical elements may control passage of voltage to the electrical contact 110, acting as a fuse, current regulator, or control device. The electrical elements may be disposed externally (i.e., along the electrical cord 116) or within the base 104.

In an embodiment, the housing 102 or base 104 may include one or more indicia 144 (e.g., FIG. 5) therealong to transmit one or more conditions to a user. The indicia may include, for example, a user interface. The indicia may change color, size, shape, or flash upon changing conditions. In an exemplary embodiment, the indicia may include one or more light emitting diodes (LED), organic light emitting diodes (OLED), other suitable display devices, or combinations thereof. The color of the indicia may change when the certain conditions change. For example, the indicia may change color when the housing 102 is engaged with the base 104. In other embodiments, the indicia may indicate successful engagement between the apparatus and base (i.e., electrical connectivity between the electrical contacts), receipt of electrical current to the housing 102, charge status, remaining volumetric capacity to receive additional substance (as discussed below), readiness for use, cleaning mode, battery level, product fault modes, system settings, or any combination thereof.

In an embodiment, the apparatus 100 may not include the base 104. For example, referring to FIG. 3, the housing 102 may include an electrical interface 302, such as for example, an integral power cord or a node for receiving a power adapter. Use of a node may permit a user to more readily store and wash the apparatus 100.

The electrical interface 302 may be recessed into the housing 102 such that no surface of the electrical interface 302 projects outwardly. A cap or cover (not illustrated) may optionally fit into the electrical interface to prevent accidental user contact therewith. In an embodiment, the electrical interface 302 may be positioned along a side surface of the housing 102. That is, the electrical interface 302 may not be positioned on the bottom or top surfaces of the housing 102. In another embodiment, the electrical interface 302 may be at least partially, such as fully, disposed on the bottom or top surfaces of the housing 102. Any number of features described above with respect to base 104 may be instead disposed on the housing 102. For example, the housing 102 may include one or more LEDs which indicate a status of the apparatus 100.

In an embodiment, the housing 102 may include a rigid substrate, such as for example a metal or hard plastic. An outer layer may be disposed around the rigid substrate and provide a user with a more secure grasp of the housing 102. In an embodiment, the outer layer may include, for example, a polymer, such as an elastomer or any other material or blend of materials. As illustrated, in certain embodiments, the outer layer may cover only a portion of the housing 102. For example, in a particular instance, the outer layer may cover between 5% and 95% of the housing 102 surface area. In further embodiments, the outer layer may cover between 10% and 90% of the housing 102 surface area, such as between 15% and 85% of the housing 102 surface area, between 20% and 80% of the housing 102 surface area, between 25% and 75% of the housing 102 surface area, between 30% and 70% of the housing 102 surface area, between 35% and 65% of the housing 102 surface area, between 40% and 60% of the housing 102 surface area, or between 45% and 55% of the housing 102 surface area. Covering some, but not all, of the housing 102 surface area with the outer layer may enhance grip therewith while reducing manufacturing costs and associated expenses while maintaining a suitable housing 102 surface finish.

Referring to FIG. 3, in certain embodiments, the outer surface of the housing 102 may be textured 306 (e.g., with dimples, recesses, ridges, protrusions, undulations, high surface roughness, another suitable texture, or any combination thereof) to enhance grip. The textured portions 306 of the housing 102 may extend along at least 5% of the housing 102 surface area, at least 10% of the housing 102 surface area, at least 20% of the housing 102 surface area, at least 50% of the housing 102 surface area, at least 75% of the housing 102 surface area, or even at least 99% of the housing 102 surface area.

In an embodiment, the housing 102 can include a main body portion 308 and a cap 304. The cap 304 may be selectively engageable with the main body portion 308 to permit user access to the main reservoir (FIG. 4) where substance is insertable and convertible into liquefied fluid. In an embodiment, engagement between the cap 304 and main body portion 308 may occur through rotation of one or both of the cap 304 and main body portion 308. For example, the cap 304 and main body portion 308 may include threads or another similar feature which permits rotatable attachment. In another embodiment, the cap 304 may engage with the main body portion 308 by a snap fit, an interference fit, a bayonet connection, a tightening band or clamp, any other suitable connection element, or a combination thereof.

A sensor (not illustrated), or one or more portions of a sensor, can be disposed along one or both of the main body portion 308 and cap 304 to detect engagement therebetween. In a particular instance, the sensor can detect when the cap 304 is engaged with the main body portion 308 and disengaged from the main body portion 308. The sensor can be in communication with one or more indicia along the housing 102 to convey a condition of engagement between the cap 304 and main body portion 308. For example, the sensor may relay a signal to the indicia indicating detachment between the main body portion 308 and cap 304, which causes the indicia to display a signal to a user communicating such condition. By way of a non-limiting example, the indicia might display a flashing orange or red light when the sensor detects disengagement or improper engagement between the cap 304 and main body portion 308. In a particular embodiment, the sensor may include a transducer adapted to respond to a magnetic field, such as a Hall Effect sensor. In other embodiments, the sensor can include an optical sensor, an electrical sensor, a thermal sensor, another suitable sensing element, or any combination thereof.

In a particular embodiment, access to the main reservoir may include a single step. For example, the cap 304 may form a portion of the main reservoir. Removal of the cap 304 may open the main reservoir, allowing user access thereto. In another particular embodiment, access to the main reservoir may include at least two steps. First, the user removes the cap 304. After the cap 304 is removed, a portal of the main reservoir (e.g., as discussed above) may be opened to allow access to the main reservoir 122.

Figure 4:
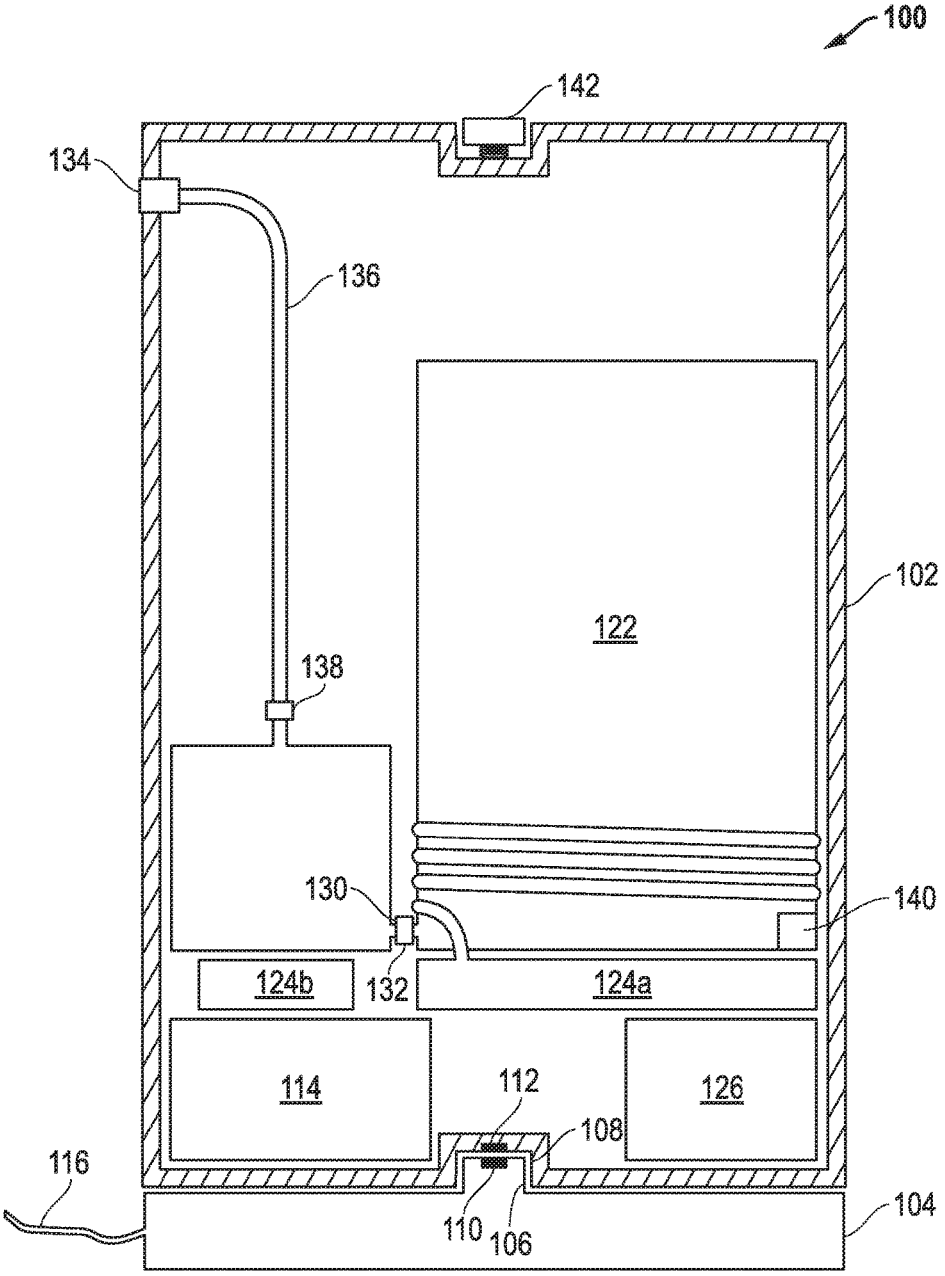
FIG. 4 includes a cross-sectional schematic view of the apparatus in accordance with an embodiment.

Referring to FIG. 4, the apparatus 100 can include a main reservoir 122 at least partially, such as entirely, disposed within the housing 102 and adapted to receive a substance. The substance may include a food product. In an embodiment, the food product may be in a solid, or generally solid, state, such as for example, a frozen or partially frozen water-in-oil emulsion like butter or a coconut oil. In another embodiment, the food product may include a primarily liquid fluid having a low viscosity and high incompressibility, such as a liquid emulsion, a colloid, or a slurry. In a more particular embodiment, the food product may include a semi-liquefied fluid. By way of a non-limiting example, the semi-liquefied fluid may include cooking oil, such as canola oil or olive oil.

In an embodiment, the main reservoir 122 may at least partially include a metal, an alloy, a ceramic, a polymer, or any combination thereof. The main reservoir 122 can include a homogenous or blended composition. In an embodiment, the main reservoir 122 can be monolithic so as to have a unitary construction. In another embodiment, the main reservoir 122 can include at least two sub-components coupled together (e.g., FIG. 6), such as for example, a body and a selectively closable portal. The portal may include a door pivotally or slidably engageable with the body so as to allow insertion of substance when in the open position. In an embodiment, the portal can further include one or more engagement elements (not illustrated) to secure the portal in the closed or open positions.

In an embodiment, the main reservoir 122, or a portion thereof, may be detachable from the apparatus 100. This may permit easier cleaning and storage, in addition to allowing individual component replacement. In certain applications, it may be desirable to store the main reservoir 122, or a portion thereof, independent of the other components in the apparatus 100. For example, left in ambient temperatures certain substances may deteriorate or spoil. Thus, the main reservoir 122, or a portion thereof, may be removed from the apparatus 100 and stored in a temperature controlled environment (e.g., a refrigerator) between uses. In another embodiment, the entire apparatus 100 can be put in the temperature controlled environment between uses.

A heating element **124*a* can be positioned to melt, or at least partially liquefy, the substance into liquefied fluid. In an embodiment, the heating element 124*a* can be disposed at least partially within the housing 102 and at least partially around the main reservoir 122. In a more particular embodiment, the heating element 124*a* may be disposed entirely within the housing 102. In an embodiment, the heating element 124*a* can include at least one wrapped coil extending around at least a portion of the main reservoir 122. In a more particular embodiment, the at least one wrapped coil can extend around an entire perimeter of the main reservoir 122. In a further embodiment, the heating element 124*a* may include at least two wrapped coils, such as at least three wrapped coils, at least four wrapped coils, or even at least five wrapped coils. The wrapped coils may extend along same, or similar, paths around the main reservoir 122 or at various angles and orientations with respect to the main reservoir 122**.

In another embodiment, the heating element **124*a* may include a fin, plate, or any other similar heat generating or delivery device disposed adjacent to the main reservoir 122. The fin or plate may extend adjacent to the main reservoir 122** so as to provide heat thereto.

In yet a further embodiment, the heating element **124*a* may include a film or generally planar sheet wrapped around at least a portion of the main reservoir 122. The film or planar sheet may directly contact the main reservoir 122. In an embodiment, the film or planar sheet may be spaced apart from the main reservoir 122**, e.g., by a further material layer or filler. The film or planar sheet may include conductive portions, resistive portions, insulative portions, or combinations thereof which may permit current flow and heat generation.

In an embodiment, the heating element **124*a* may be a resistance heating element, controllable through modification of power supplied thereto. Temperature of the heating element 124*a* may be monitored by thermal sensitivity (e.g., a sensor) and controlled by a logic element 126. As used herein, the logic element 126 can include one or more logic elements either coupled together or independently operating separately from one another. The logic element 126 may be in communication with the heating element 124***a* and one or more sensors to effectively monitor and adjust the temperature of the heating element 124*a*. In an embodiment, the logic element 126 may be programmable so as to allow selective heating (i.e., only certain temperatures are permitted) or continuous heating (i.e., the heating element can be set to operate at any desirable temperature).

In an embodiment, the heating element 124*a* can be disposed adjacent to a lower portion 126 of the main reservoir 122. That is, the heating element 124*a* can be disposed adjacent to the main reservoir 122 at a lowest vertical elevation when the housing 102 is in an upright position, e.g., coupled with the base 104. This may reduce unwanted solidification of liquefied fluid within the main reservoir 122.

In another embodiment, the heating element 124*a* can be disposed at a middle or upper portion of the main reservoir 122, e.g., at a middle or upper elevation of the main reservoir 122 when the housing 102 is in an upright position.

In an embodiment, the heating element 124*a* may be selectively engageable between an on-position and an off-position. Selective engagement may be possible through one or more switches disposed along an exterior surface of the housing 102. The one or more switches may be electrically coupled to the logic element 126 which can communicate with a power source 114 to deliver electrical current to the heating element 124*a*. The power source 114 may include a battery, such as a rechargeable battery, which can hold a charge. In an embodiment, the power source 114 can include a plurality of batteries either arranged in parallel or series. In certain embodiments, the power source 114 can be removable from the apparatus 100, through, for example, an opening disposed along the housing 102. An optional gate (not illustrated) can hold the power source 114 in place within the housing 102. The gate can be selectively opened and closed to permit access to the removable power source 114. In certain embodiments, the power source 114 can be recharged, for example, using electromagnetic fields as provided by a charging station (e.g., a base). In such embodiments, energy can be delivered to the power source 114 through inductive coupling, such as generated by an induction coil, to create an alternating electromagnetic field from within the charging station. An induction coil or similar receiver coupled to the power source 114 can take power from the electromagnetic field and convert the power into electrical current to charge the power source 114.

Once engaged, the heating element 124*a* can elevate the internal temperature of the main reservoir 122 until the logic element 126 and a sensor, or other monitoring device, determine the appropriate temperature has been reached.

In a further embodiment, the logic element 126 can selectively engage the heating element 124*a* between on- and off-positions. That is, the logic element 126 may cycle the heating element 124*a* on and off. In an embodiment, the logic element 126 may disengage the heating element 124*a* upon reaching a prescribed temperature, e.g., 160° F. Upon cooling below another prescribed temperature, e.g., 155° F., the logic element 126 may reengage the heating element 124*a*. Thus, the heating element 124*a* can efficiently maintain the main reservoir 122 within a suitable temperature range (e.g., 165° F. to 170° F.) for liquification of the substance.

Figure 15:
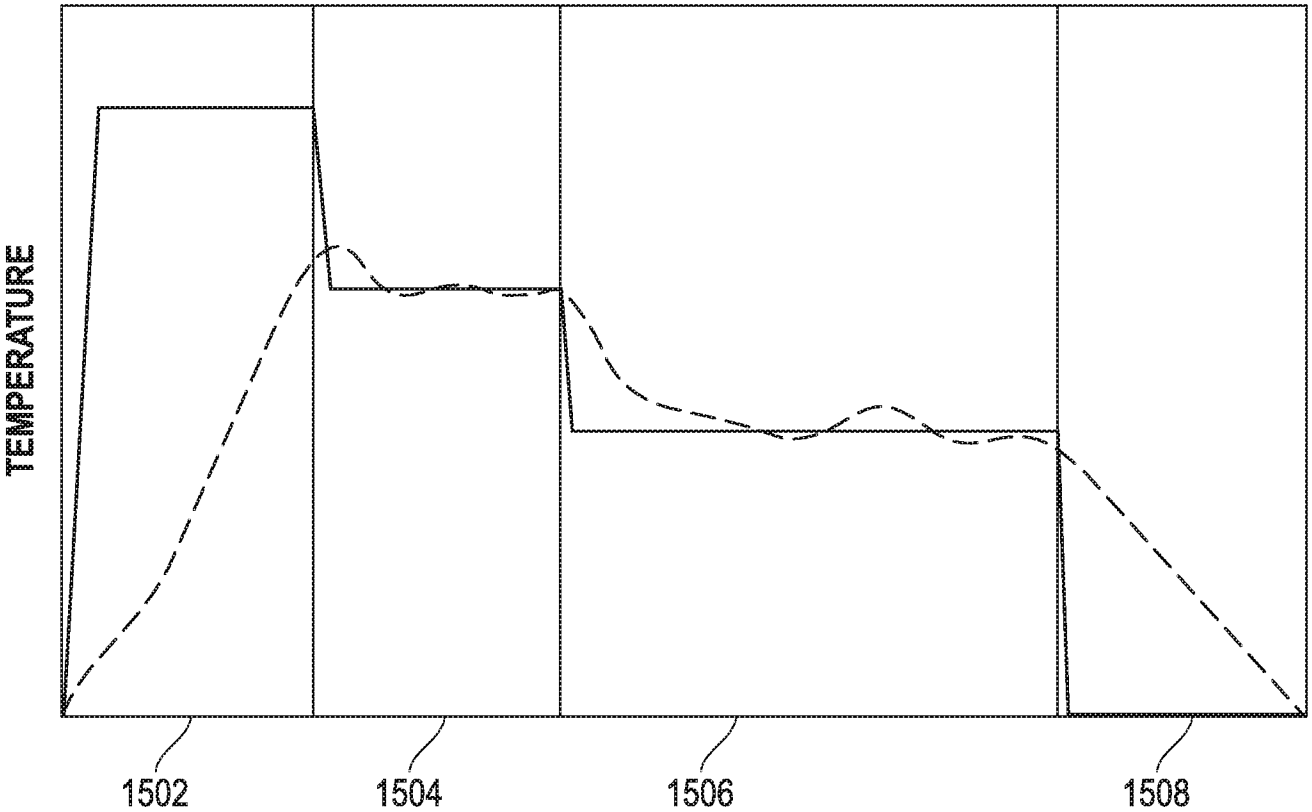
FIG. 15 includes a chart illustrating an exemplary temperature profile of the main reservoir in accordance with an embodiment.

FIG. 15 illustrates an exemplary temperature profile for the main reservoir (solid line) as controlled by the heating elements from startup to shutdown. Temperature of the substance contained therein is illustrated by dashed line. As illustrated, a delay exists between temperature change of the main reservoir and temperature change of the substance. Such delay may be exaggerated in the illustrated temperature profile for ease of understanding.

In an embodiment, heating protocol can begin during startup 1502 during which time the heating element may be brought to a temperature above optimal dispersal use. For example, if ideal dispersal temperature is 120° F., startup can be performed at, or around, 150° F. Such elevated temperature may accelerate heating, thereby reducing startup time. It is important for startup temperature to be no higher than a certain threshold temperature for the substance being melted as certain substances may denature or sour at very high temperatures (e.g., 250° F.). For such substances, startup 1502 temperature may be close to dispersal temperature. In an embodiment, startup 1502 may require between 5 seconds and 60 seconds, such as between 10 seconds and 40 seconds, or even between 15 seconds and 30 seconds. Startup 1502 may terminate when the substance reaches a set temperature, at which point maintenance 1504 of the temperature begins. Maintenance 1504 generally lowers the temperature of the heating element from startup temperature to an appropriate temperature for dispersal. It is during maintenance 1504 that dispersal of liquefied fluid is optimal. As illustrated, the heating element may cycle on and off during maintenance 1504. Such cycling may be automatically controlled by the logic element. After a prescribed time period, which may be preset or user controlled (e.g., 60 seconds, 120 seconds, or 180 seconds), a standby period 1506 may begin. The standby period 1506 further lowers the temperature of the heating element below that of maintenance 1504 to a level by which the temperature can be rapidly increased when dispersal is demanded. In this regard, power usage can be reduced and heat-generated stress to the components can be reduced. After a prescribed time period (e.g., 300 seconds or 600 seconds), which may be preset or user controlled, shutdown 1508 can begin. Shutdown 1508 generally involves reduction in temperature of the main reservoir 122 and substance to room temperature. Shutdown 1508 can be performed gradually such that temperature of the main reservoir 122 slowly decreases or immediately such that temperature decreases more rapidly.

In a particular instance, the apparatus 100 can include a motion detection element (not illustrated) coupled to the logic element and adapted to detect when the apparatus 100 is in motion. The motion detection element can include, for example, an accelerometer or other similar device positioned within or on the housing 102 and adapted to sense when the apparatus 100 is touched, shaken, raised, lowered, rotated, placed on a surface, or exposed to any combination thereof. The logic element can use information provided by the motion detection element to control, for example, the heating protocol. That is, the logic element can selectively raise and lower the temperature of the main reservoir or other component within the apparatus 100 upon indication of relative motion of the apparatus. If a user raises the apparatus 100 from a surface, the accelerometer can send a signal to the logic element communicating such motion. The logic element can then engage the heating element to a desired temperature, initiating startup. In this regard, the apparatus 100 can be a smart system adapted to operate with minimal user input. Similarly, if the accelerometer detects no movement for a period of time (e.g., 30 seconds, 60 seconds, etc.) the logic element can initiate standby or shutdown of the apparatus 100.

Referring again to FIG. 4, in an embodiment, the logic element 126 may be programmed to maintain the heating element 124*a* in the on-position until accumulation of a predetermined volume of liquefied fluid in the main reservoir 122. A main sensor 140 disposed in the main reservoir 122 can sense the volume of liquefied fluid and transmit a signal to the logic element 126 which can selectively disengage the heating element 124*a* or engage a biasing element, as discussed in greater detail below, upon reaching a predetermined volume of liquefied fluid.

In yet a further embodiment, the logic element 126 may adaptively control a radiated temperature of the heating element 124*a*. That is, the heating element 124*a* may have multi-temperature operational capacity adapted to adjust the radiated temperature according to preset conditions in the logic element 126.

In an embodiment, the heating element 124*a* may be adapted to heat the main reservoir 122 to at least 100° F., such as at least 110° F., at least 120° F., at least 130° F., at least 140° F., at least 150° F., at least 160° F., at least 170° F., at least 180° F., at least 190° F., or even at least 200° F. One or more programmable settings in the logic element 126 can control the desired temperature of the main reservoir 122 or even the rate at which the temperature in the main reservoir 122 increases. For particular applications, the heating element 124*a* may heat the main reservoir 122 to a desired temperature within no greater than 25 seconds, such as no greater than 20 seconds, no greater than 15 seconds, no greater than 10 seconds, or even no greater than 5 seconds.

The heating element 124*a* may be adapted to radiate different amounts of heat at different locations. That is, the heating element 124*a* can radiate a first temperature at a first location and a second temperature at a second location, where the first and second temperatures are different from one another. For example, a portion of the heating element 124*a* disposed at a middle elevation of the main reservoir 122 may have a higher temperature as compared to a portion of the heating element 124*a* disposed at a lower elevation of the main reservoir 122. Such targeted heat exposure can simultaneously melt the substance in a first portion of the main reservoir while efficiently maintaining liquefied fluid in the liquid state.

In an embodiment, the apparatus 100 can further include a second reservoir 128 in fluid communication with the main reservoir 122. The second reservoir 128 can have a second volume, $V_2$, different than a first volume, $V_1$, of the main reservoir 122. In a particular embodiment, $V_1$ can be greater than $V_2$. For example, $V_1$ can be at least 1.01 $V_2$, such as at least 1.05 $V_2$, at least 1.1 $V_2$, at least 1.25 $V_2$, at least 1.5 $V_2$, at least 1.75 $V_2$, at least 2.0 $V_2$, at least 3 $V_2$, at least 4 $V_2$, at least 5 $V_2$, or even at least 10 $V_2$. In another embodiment, $V_1$ can be no greater than 100 $V_2$, such as no greater than 75 $V_2$, no greater than 50 $V_2$, or even no greater than 25 $V_2$.

In an embodiment, the second reservoir 128 may comprise a material similar to the main reservoir 122. For example, the second reservoir 128 may at least partially include a metal, an alloy, a ceramic, a polymer, or any combination thereof. In another embodiment, the second reservoir 128 may have non-similar attributes as compared to the main reservoir 122. For example, the second reservoir 128 may have a single piece construction whereas the main reservoir 122 may include multiple pieces joined together.

The second reservoir 128 can be spaced apart from the main reservoir 122 and coupled thereto by a passageway 130. The passageway 130 can include a tube or an extension from one of the main reservoir 122 or second reservoir 128. In an embodiment, the passageway 130 can include a material different from the material of the main reservoir 122 and second reservoir 128. Exemplary materials for the passageway 130 include polymers, metals, alloys, and combinations thereof. The passageway 130 may be secured to the main reservoir 122 and second reservoir 128 by a clamp, an adhesive, an interference fit, another suitable method, or any combination thereof. In an embodiment, the passageway 130 may be disposed at, or adjacent, a lowest vertical elevation of the main reservoir 122, such that liquefied fluid can pass to the second reservoir 128 under, or with the assistance of, gravitational force.

Liquefied fluid may pass from the main reservoir 122, through the passageway 130, to the second reservoir 128 where the liquefied fluid may remain in the liquid state for dispersal. Bi-reservoir capability may enhance reliability of the apparatus 100. More particularly, the use of a main reservoir 122 to melt substance into liquefied fluid, and a secondary reservoir 128 to receive and maintain the liquefied fluid for dispensing can increase reliability of the apparatus while simultaneously increasing efficiency. Because the second reservoir 128 has a smaller internal volume, maintaining liquefied fluid within the second reservoir reduces heating load, thus reducing energy consumption. Moreover, an operator can safely access the main reservoir 122 with liquefied fluid ready for dispersion in the second reservoir 128. This may facilitate easier troubleshooting of problems which might arise during use, such as clogging or any broken components.

Liquefied fluid may be biased from the main reservoir 122 to the second reservoir 128 by a biasing element 132 in fluid communication with the passageway 130. In an embodiment, the biasing element 132 may include a pump. The biasing element 132 can be selectively engageable, moving between an on-position and an off-position controlled by the logic element 126. In a further embodiment, the biasing element 132 may have a multi-modal operation, whereby the biasing element 138 can generate a plurality of different pressures each urging liquefied fluid at different flow rates.

In another embodiment, the biasing element 132 can include a cartridge or other replaceable element having an internal pressure greater than pressure of the surrounding environment.

In an embodiment, the heating element 124*a* may include a portion extending along and adjacent to the passageway 130. For example, one or more coils can extend from the portion of the heating element 124*a* adjacent to the main reservoir 122 and extend at least partially around the passageway 130. In an embodiment, the portion of the heating element 124*a* adjacent to the passageway 130 may be at a lower temperature than the portion of the heating element 124*a* adjacent to the main reservoir 122. In another embodiment, a separate heating element (not illustrated) may be disposed adjacent to the passageway 130. In this regard, the passageway 130 can be maintained at a suitable temperature to prevent solidification of the liquefied fluid.

Figure 5:
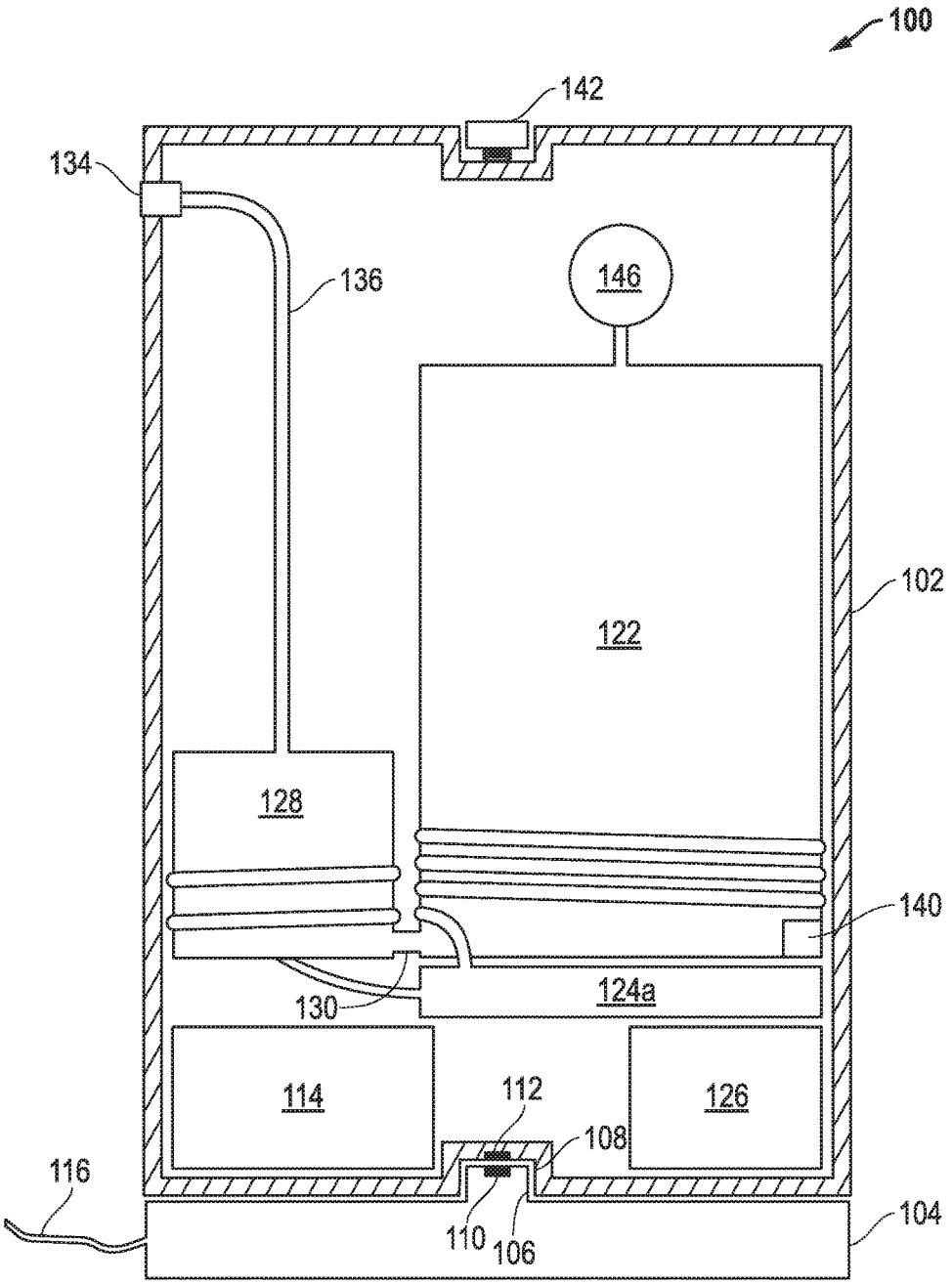
FIG. 5 includes a cross-sectional schematic view of an apparatus in accordance with an embodiment.

In an embodiment, the heating element 124*a* may also extend at least partially around the second reservoir 128 (FIG. 5). One or more coils can extend from the portion of the heating element 124*a* adjacent to the main reservoir 122 and extend at least partially around the second reservoir 128 (FIG. 5). In another embodiment, a further heating element 124*b* may be disposed adjacent to the second reservoir 128 (FIG. 4). The heating element 124*b* may be similar or the same as heating element 124*a*. Moreover, heating element 124*b* may operate in a similar manner as heating element 124*a*. That is, heating element 124*b* may be selectively engageable by the logic element 126. In this regard, the second reservoir 128 can be maintained at a suitable temperature to prevent solidification of the liquefied fluid therein.

In an embodiment, an average temperature within the main reservoir 122 may be lower than an average temperature within the second reservoir 128. That is, the average temperature, as measured by an average temperature throughout the entire volume, of the second reservoir 128 may be higher than the average temperature, as measured by an average temperature throughout the entire volume, of the main reservoir 122. This may occur when solid or semi-solid substance is disposed in the main reservoir 122, the solid or semi-solid substance inherently having a lower average temperature than liquefied fluid (i.e., liquefied substance) and thereby causing the main reservoir 122 to have a lower average temperature. Alternatively, the average temperature within the main reservoir 122 may be approximately equal to the average temperature within the second reservoir 128 if the temperature supplied by the heating element 124*a* is greater as observed in the main reservoir 122 as compared to the second reservoir 128.

A nozzle 134 may be in fluid communication with the second reservoir 128 and adapted to dispense liquefied fluid from the second reservoir 128 to an external environment (outside the housing 102). That is, liquefied fluid can pass from the main reservoir 122 to the second reservoir 128, and can be dispensed at the nozzle 134. The second reservoir 128 can be disposed between the nozzle 134 and the main reservoir 122.

A passageway 136 connecting the second reservoir 128 to the nozzle 134 may be in fluid communication with a biasing element 138. In a non-illustrated embodiment, an additional heating element, or a portion of a previously described heating element, may be disposed along, or adjacent to, a portion of the passageway 136. Similar to those previously described heating elements, the heating element adjacent to the passageway 136 may prevent solidification of any residual liquefied fluid remaining. The additional heating element may also, or alternatively, be disposed around, or adjacent to, the nozzle 134.

The biasing element 138 can be disposed at least partially within the housing 102 and can bias liquefied fluid from the second reservoir 128 to the nozzle 134. In an embodiment, the biasing element 138 can include a pump. The biasing element 138 can be selectively engageable, moving between an on-position and an off-position controlled by the logic element 126. In a further embodiment, the biasing element 138 may have a multi-modal operation, whereby the biasing element 138 can generate a plurality of different pressures each urging liquefied fluid at different flow rates.

In an embodiment, the biasing element 138 may provide a constant biasing pressure to liquefied fluid passing through the passageway 136 to the nozzle 134. In a particular embodiment, a pressure differential, $\Delta P$, of liquefied fluid passing through the nozzle 134, as measured during a continuous 10 second interval of dispensing, can be less than 5 pounds per square inch (PSI), such as less than 4 PSI, less than 3 PSI, less than 2 PSI, less than 1 PSI, less than 0.5 PSI, or even less than 0.1 PSI. That is, pressure at the nozzle 134 can remain relatively constant over a period of time. In a more particular embodiment, the pressure differential, $\Delta P$, of liquefied fluid passing through the nozzle 134, as measured during a continuous 10 second interval of dispensing, can be approximately 0 PSI. As used herein, "approximately 0 PSI" refers to a pressure differential of no greater than 0.1 PSI such that the pressure differential is not visibly noticeable during use.

In another embodiment, the biasing element 138 can include a cartridge or other replaceable element having an internal pressure greater than pressure of the surrounding environment.

The biasing element 138 may be adapted to provide a fluid biasing pressure of at least 5 PSI, such as at least 10 PSI, at least 15 PSI, at least 20 PSI, at least 25 PSI, or even at least 30 PSI. In an embodiment, the biasing element 138 can generate no greater than 100 PSI, such as no greater than 75 PSI, or even no greater than 50 PSI.

Referring now to FIG. 4, and in accordance with another embodiment, a biasing element 146 can be in fluid communication with the main reservoir 122 and may provide a biasing pressure throughout the entire system. That is, the biasing element 146 can selectively bias liquefied fluid from the main reservoir 122 to the nozzle 134. The biasing element 146 may have any similar feature or characteristic as those biasing features 132 and 138 already described above.

In an embodiment, the nozzle 134 can receive and atomize the liquefied fluid from the housing 102 to the external environment. Atomizing the liquefied fluid can result in a spray of fine droplets. In a particular embodiment, the atomized fluid can have an average fluid particle diameter of less than 1000 microns, such as less than 500 microns, less than 400 microns, less than 350 microns, less than 300 microns, less than 250 microns, less than 200 microns, less than 150 microns, or even less than 100 microns. Small droplet size may increase surface coverage, prevent pooling, and more evenly coat an object being sprayed.

In another embodiment, the nozzle 134 can receive and spray the liquefied fluid in a non-atomized manner, i.e., a spray or a mist having an average fluid particle diameter greater than an atomized spray.

Various spray patterns can be formed using different sized and shaped nozzles. In an embodiment, when stationary and activated from a distance of 1 inch from a surface under a pressure of 25 PSI, the nozzle 134 produces a spray pattern having an average diameter of at least 1 inch, such as at least 2 inches, at least 3 inches at least 4 inches, at least 5 inches, or even at least 10 inches.

The spray pattern may have a relatively uniform spray profile. That is, the fluid particle density at a location within the spray pattern may be relatively the same as the fluid particle density at a different location.

Atomization of liquefied fluid through the nozzle 134 may be controllable by a selectively engageable actuator 142. In an embodiment, the actuator 142 is disposed along the housing 102 such that at least a portion is visible to a user. The actuator 142 may be a linear actuator, such as a switch, or a depressible element, such as a button. In an embodiment, the actuator 142 is linearly depressible. In another embodiment, the actuator 142 is pivotally depressible. Engagement of the actuator 142 may engage the biasing element 138 which in turn may atomize liquefied fluid through the nozzle 134.

In an embodiment, the apparatus 100 can include a light generating element to illuminate the atomized liquefied fluid. The light generating element can be positioned at a location adjacent to the nozzle 134 and provide illumination of the atomized liquefied fluid. Certain liquefied fluids are difficult to view in certain lighting conditions. For example, liquefied butter can be difficult to visually perceive in the liquefied state in certain lighting conditions. Use of a light generating element can assist an operator in dispersing a desired volume of liquefied fluid by permitting visual confirmation of volumetric dispersal. Additionally, the light generating element can relay a condition or status to the operator. For example, different color lights or different light intensities can display the dispersal rate or an indication of remaining, undispersed liquefied fluid. By way of example, the light can be yellow during normal spraying operations and red when liquefied fluid levels are below a predefined level, thus indicating dispersal should soon be terminated.

In an embodiment, a volume of liquefied fluid dispersed through the nozzle can be selectively controlled by an operator. That is, the apparatus can deliver controllable volumes of liquefied fluid per actuation. The controlled volumes may be selectively adjustable based on any one of volume, caloric content, or any other suitable metric.

A display (not illustrated) positioned along the apparatus 100 can relay information to the operator about conditions of the apparatus 100 or liquefied fluid being dispersed. For example, in an embodiment, the display can indicate a volume of previously dispersed liquefied fluid, calorie count per volume dispersed, a total calorie counter per use, grams of liquefied fluid dispersed, volumetric capacity of the main reservoir, a liquefied fluid gauge indicating a volume of remaining liquefied fluid ready to dispense, or any combination thereof.

In an embodiment, the apparatus 100 can communicate with a secondary device, such as a smart phone, a computer, a network, a server, or any other suitable electronic device capable of receiving transmitted signals. In this regard, a user can access operational information from the secondary device. The secondary device can illustrate, for example, any of the previously listed attributes such as dispersal volume, apparatus status, main reservoir temperature, or any combination thereof. In a further embodiment, the user may also control the apparatus 100 from the secondary device. For example, the user can remotely engage the heating cycle prior to use. The secondary device can then indicate to the user that the apparatus has reached temperature. In certain instances, the apparatus 100 and secondary device can be in communication through a wired connection, such as through the use of a wire or similar electrically conductive pathway. In other instances, the apparatus 100 can communicate with the secondary device through one or more wireless protocol. Exemplary wireless communication protocols include infrared and ultrasonic communication, radio waves, microwaves, Wi-Fi, and Bluetooth communication protocols. Communication protocol is not intended to be limited by the above list and can further include additional wireless communication protocol and combinations thereof. In a particular instance, a low energy protocol may permit extended usage before requiring additional charging.

Figure 6:
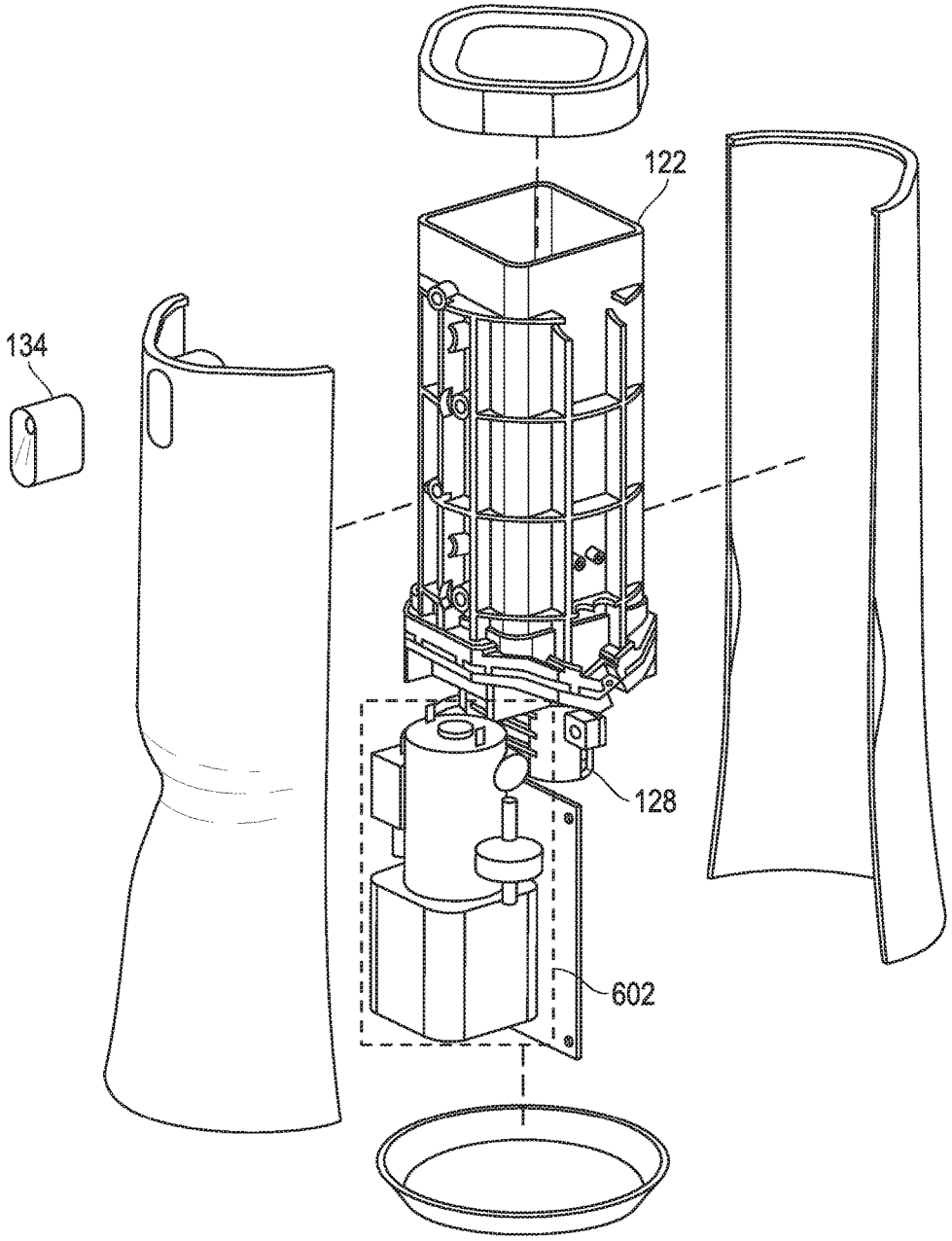
FIG. 6 includes an exploded perspective view of an apparatus in accordance with an embodiment.

Referring to FIG. 6, in an embodiment, the second reservoir 128 may be disposed below the main reservoir 122. Liquefied fluid from the main reservoir 122 may pass to the second reservoir 128 under gravitational force. That is, the second reservoir 128 may be gravity fed. It is believed that effective gravitational operation may occur at angles of less than 90 degrees from vertical, such as less than 80 degrees from vertical, less than 70 degrees from vertical, less than 60 degrees from vertical, less than 50 degrees from vertical, or less than 40 degrees from vertical.

In an embodiment, the second reservoir 128 can have a length, a width, and a depth all perpendicular to one another where the length is greater than the width and depth. As illustrated, the length of the second reservoir 128 may extend transverse to a direction of fluid dispersal from the nozzle 134. That is, the largest dimension of the second reservoir 128 may be perpendicular to the direction of spray. During spraying, most users tilt the apparatus 100 forward. Alignment of the second reservoir 128 perpendicular to such tilting reduces sloshing which can expose the outlet and cause intermittent spraying. Such orientation of the second reservoir 128 is non-limiting, as in another embodiment, the second reservoir 128 can be oriented parallel with the direction of fluid dispersal or at any other rotational orientation with respect thereto.

In a non-limiting embodiment, the logic element, pump, power source, and any other elements necessary for operation may be disposed in a cluster 602 below the main reservoir 122. In a particular embodiment, the cluster 602 may also be disposed below the second reservoir 128. In yet a further embodiment, a line extending horizontally through the cluster 602 may intersect the second reservoir 128. That is, at least a portion of the cluster 602 may lie along a same horizontal line as the second reservoir 128.

A screen or filter (FIG. 7) positioned between the main and second reservoirs 122 and 128 may prevent passage of solid substance from passing to the second reservoir 128.

Figure 7:
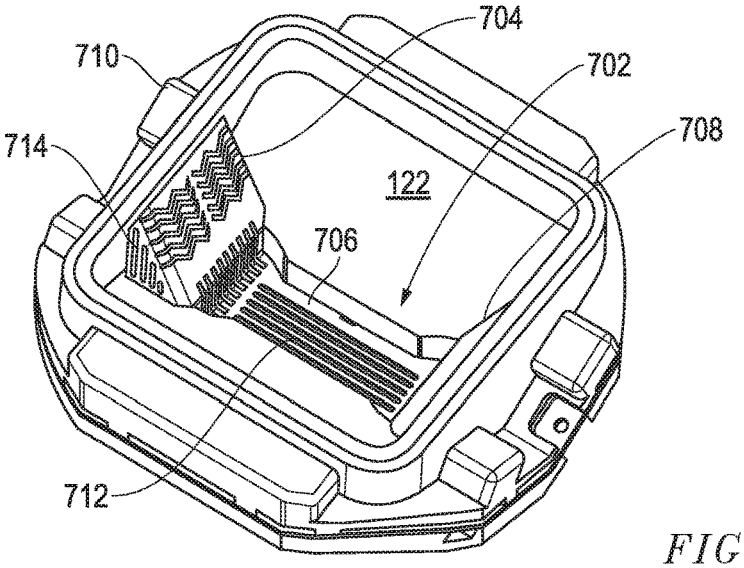
FIG. 7 includes a perspective view of a portion of the main reservoir including a filter in accordance with an embodiment.

Referring to FIG. 7, the filter 702 may include a body 704 defining a bottom surface 706. The body 704 may further define a side surface 708 and a side surface 710. The side surfaces 708 and 710 may extend from the bottom surface 706 at any relative angle. Further, sub-surfaces (e.g., surface 714) may extend from the side surfaces 708 and 710 to permit desirable contouring for filtering.

As illustrated, the side surfaces 708 and 710 may include one or more apertures 712 which pass through the body 704 to permit passage of liquefied fluid to the second reservoir. In an exemplary embodiment, the filter 702 can include at least one aperture, at least two apertures, at least three apertures, at least four apertures, at least five apertures, at least ten apertures, at least twenty apertures, or even at least fifty apertures.

At least one of the apertures 712 may include a feature adapted to disrupt surface tension of the liquefied fluid. That is, the aperture 712 may have an attribute which prevents surface tension of the liquefied fluid from being too high as to permit fluid passage through the filter. As illustrated, the surface tension disrupting feature may include undulating, such as jagged, aperture sidewalls. In certain embodiments, at least two of the apertures 712 may include surface tension disrupting features, at least three of the apertures 712 may include surface tension disrupting features, at least four of the apertures 712 may include surface tension disrupting features, at least five of the apertures 712 may include surface tension disrupting features, at least ten of the apertures 712 may include surface tension disrupting features, or all of the apertures 712 may include surface tension disrupting features. In a particular instance, at least one of the apertures can include multiple surface tension disrupting features. The features of the apertures 712 may be similar or different. For example, as illustrated, rows of similarly shaped apertures 712 may provide sufficient passage of liquefied fluid for certain substances. However, other substances with different material compositions may utilize apertures of different sizes, shapes, contours, or position relative to the body 704.

The apertures 712 may define an open area defined by a perimeter of the aperture 712. In a particular embodiment, the open area of at least one, such as all, of the apertures may be at least 0.001 square inches, at least 0.01 square inches, or at least 0.1 square inches. Aperture sizing may be determinable by intended substance. Thus, in an embodiment, the filter 702 is readily accessible, removable, replaceable, or a combination thereof, thus allowing a user access to switch the filter appropriately when using different substances to best handle fluid properties of said substance.

In a particular instance, the body 704 of the filter 702 may include a metal, an alloy, a ceramic, a polymer, or any combination thereof. The body 704 may be formed from a single piece (e.g., a billet) or multiple pieces affixed together. In an embodiment, the body 704 may include a substrate and an outer layer. The outer layer may be applied as a sheet or through a deposition technique, such as spray coating or electroplating. In a particular instance, the outer layer may be antimicrobial or have another feature which enhances operation of the filter 702. The body 704 may be shaped to fit into the main reservoir 122, the second reservoir 128, or at a location therebetween. In an embodiment, at least a portion of the filter 702 extends into the main reservoir 122, the second reservoir 128, or a combination thereof. That is, the filter 702 can extend into the volume of at least one of the main and second reservoirs 122 and 128.

In an embodiment, the filter 702 snaps into position. One or more tabs, projections, recesses, lips, nodules, similar features, or a combination thereof can selectively secure the filter 702 relative to the main and second reservoirs 122 and 128. In another embodiment, the filter 702 is attached via one or more threaded or non-threaded fasteners, an adhesive, one or more clamps, mechanical deformation (e.g., crimping), by another suitable engagement element, or any combination thereof.

Figure 8:
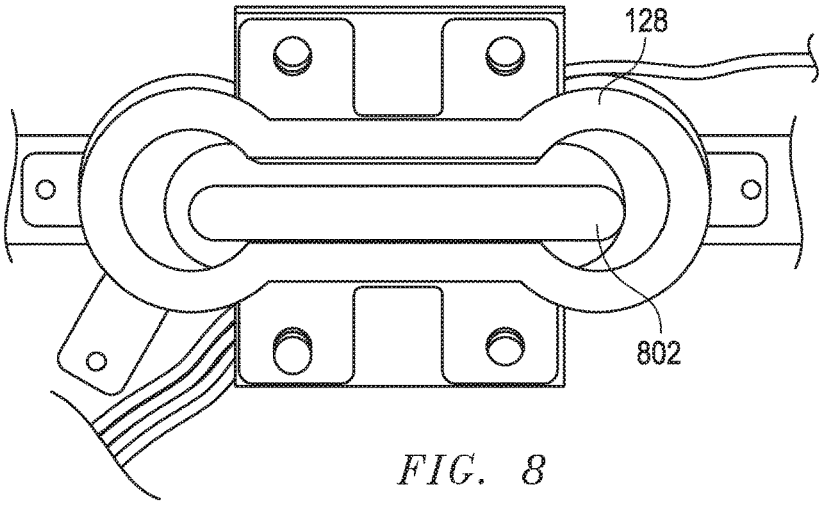
FIG. 8 includes a top view of a second reservoir and float in accordance with an embodiment.
Figure 9:
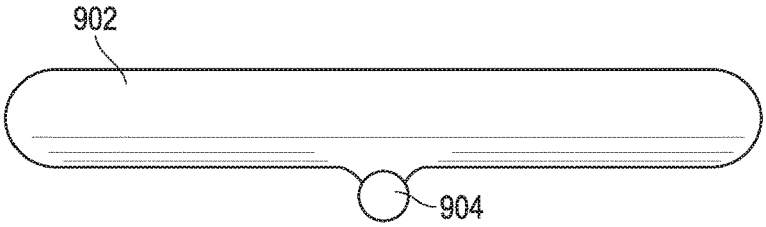
FIG. 9 includes a side elevation view of a float including an elongate tube and a magnetic element in accordance with an embodiment.

FIG. 8 illustrates an embodiment of the second reservoir 128 as viewed from the filter 702. A volume detecting element may detect a volume of liquefied fluid within the second reservoir 128 and communicate said volume to the logic element. Volumetric detection may be performed by weight, float, ruler, laser level, temperature, spectral properties, emissivity, conductivity, transparency, specific heat, specific gravity, viscosity, surface tension, mass, resonance, sight, capacitance, ultrasonic detection, refractive index, acoustic transitivity, sonar, mass flow rate, vapor pressure, displacement of gas, vibration, a dip stick, heat flux, hydrostatic pressure, a magnetic field, or any combination thereof. In a particular embodiment, volumetric detection may be performed using a Hall Effect sensor. A float 802 disposed within the second reservoir 128 may include a magnetic element monitored by a sensor. As the level of liquefied fluid within the second reservoir 128 increases, the float 802 rises and detection of the magnetic element registers said increased level of liquefied fluid. As illustrated, for example, in FIG. 9, the float may include an elongate tube 902. The elongate tube 902 and magnetic element 904 may have a cross-sectional shape generally similar to the cross-sectional shape of the second reservoir 128. Referring again to FIG. 8, the float 802 may extend along at least 50% of the cross-sectional area of the second reservoir 128, such as at least 75% of the cross-sectional area of the second reservoir. In another embodiment, the float 802 may have any other suitable shape including, for example, polygonal segments, arcuate segments, and segments having polygonal and arcuate portions interconnected together.

When the float 802 reaches a preset level, the heating element may be selectively moved to the on-position to prevent liquefaction of further substance. In an embodiment, the preset level may be programmable by a user. That is, the user may select an appropriate volume of liquefied fluid for melting. In another embodiment, the preset level can be automatically programmed such that the user cannot adjust volumetric fluid level.

Figure 10:
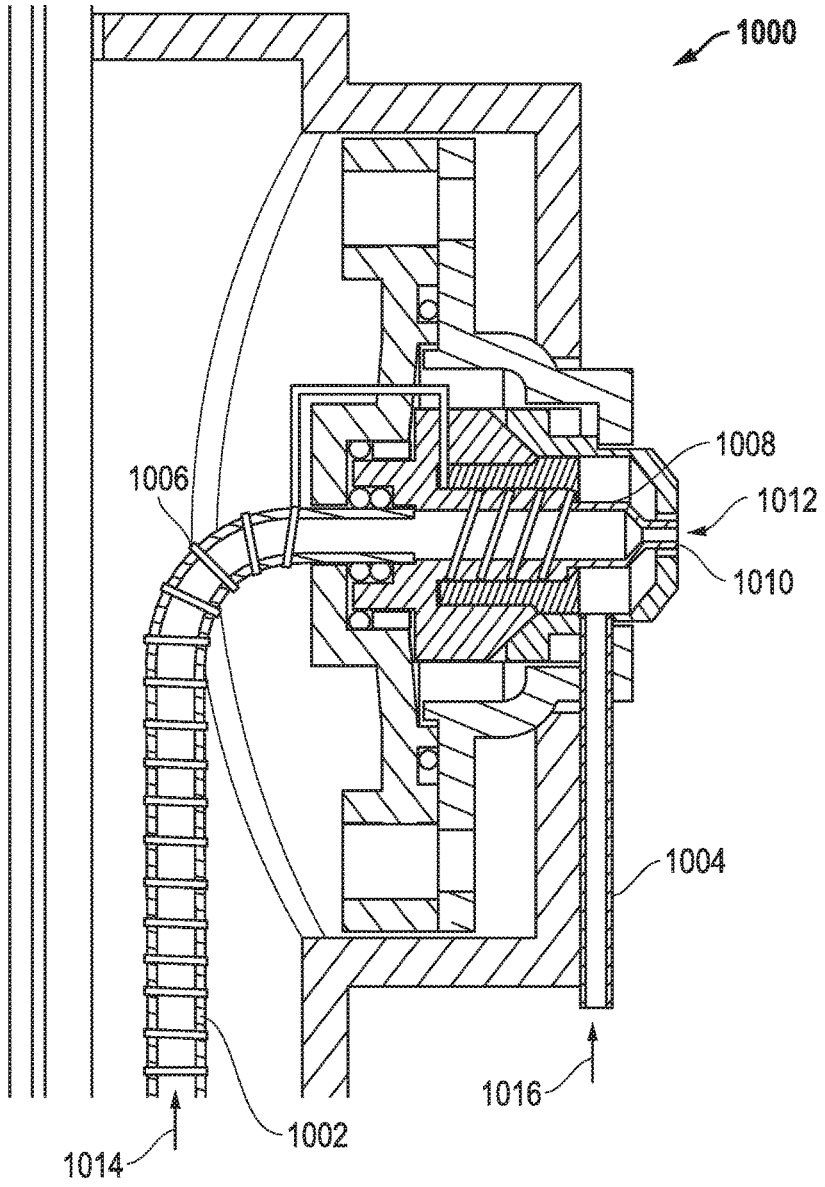
FIG. 10 includes a cross-sectional elevation view of a nozzle in accordance with an embodiment.

FIG. 10 illustrates a cross-sectional view of a nozzle 1000 in accordance with an embodiment. The nozzle 1000 can include a liquefied fluid inlet 1002 and an air inlet 1004. Liquefied fluid can pass through the liquefied fluid inlet 1002 in a direction indicated by arrow 1014; air (e.g., pressurized air) can pass through the air inlet 1004 in a direction indicated by arrow 1016. One or more heating elements 1006 can extend along at least a portion of the liquefied fluid inlet 1002. In an embodiment, the one or more heating elements 1006 can extend continuously along a length of the liquefied inlet 1002. A nozzle head 1008 can be in fluid communication with the liquefied fluid inlet 1002. The nozzle head 1008 can have a tapered or otherwise narrowing outlet 1010 to increase fluid pressure. The air inlet 1004 can be positioned adjacent to the nozzle head 1008, providing pressurized air at the outlet 1010. In a particular embodiment, the pressurized air provided through the air inlet 1004 can mix with the liquefied fluid from the nozzle head 1008 at, or immediately adjacent to the nozzle outlet 1012. In such a manner, the liquefied fluid may be atomized, resulting in fine particulate dispersal.

Figure 11:
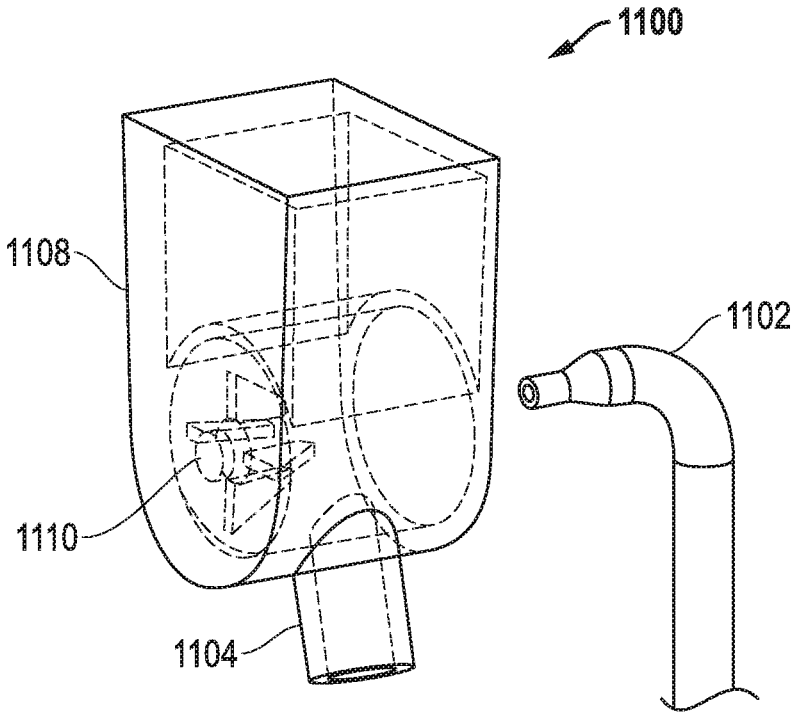
FIG. 11 includes a partially transparent, exploded perspective view of a nozzle in accordance with an embodiment.

In an embodiment, the nozzle can include a monolithic, or generally monolithic, construction. For example, as illustrated in FIG. 11 the nozzle 1100 can include a nozzle head 1108 formed from a single piece and a liquefied fluid inlet 1102. Similar to the nozzle 1000 illustrated in FIG. 10, the nozzle head 1108 can be in fluid communication with the liquefied fluid inlet 1102. The nozzle head 1108 can be formed, for example, by molding, material removal, deposition, or another similar technique permitting single piece construction. The nozzle head 1108 can have an integral air inlet 1104 which permits air (e.g., pressurized air) to mix with the liquefied fluid at, or adjacent to, the outlet 1110.

Figure 12:
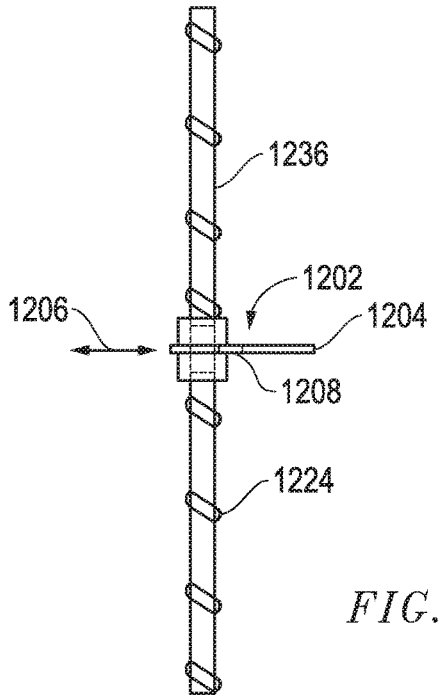
FIG. 12 includes a side elevation view of a passageway between a nozzle and a second reservoir in accordance with an embodiment.
Figure 13:
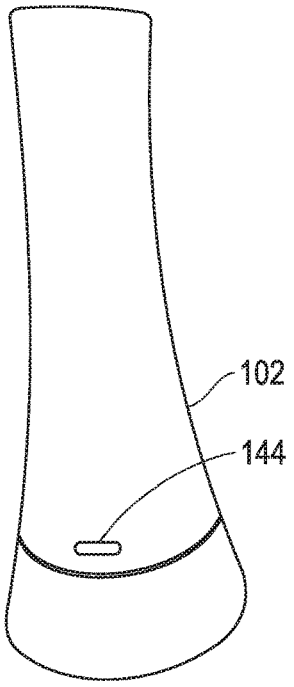
FIG. 13 includes a front perspective view of an apparatus in accordance with an embodiment.
Figure 14:
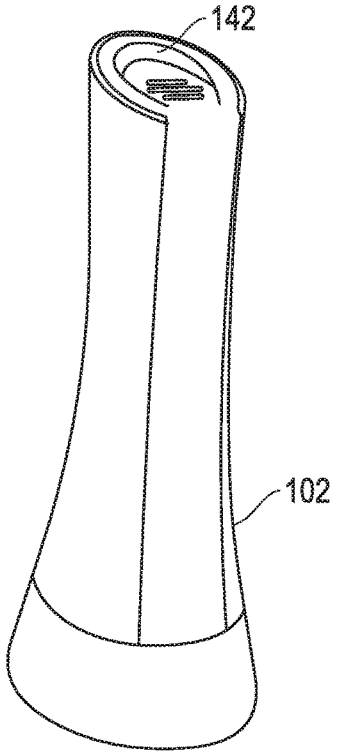
FIG. 14 includes a back perspective view of the apparatus of FIG. 13, in accordance with an embodiment.

Referring to FIG. 12, passageway 1236 connecting the second reservoir 128 and nozzle 134 may include a selectively engageable element 1202 adapted to selectively terminate flow of liquefied fluid to the nozzle 134. In an embodiment, the element 1202 can include a guillotine or other similar transversal element 1204 adapted to block flow of fluid when in the closed configuration. The element 1204 may slide along axis 1206 from closed configuration (as illustrated) to an open configuration in which an opening 1208 is in fluid communication with the passageway 1236. Heating element 1224 can extend over the element 1202 or terminate prior thereto. In another exemplary embodiment, the element 1202 can include an actuated member which pinches the passageway 1236. The actuated member may be controlled by one or more motors which can actuate the actuated member into pinching position, whereby the passageway 1236 is closed.

Referring again to FIG. 1, the housing 102 may have a generally cylindrical shape. In an embodiment, the actuator 142 may be disposed along a sidewall of the housing 102, or at least partially along the sidewall of the housing 102 (FIGS. 1 and 2). In another embodiment, the actuator 142 may be disposed at an axial end of the housing 102 (FIGS. 5 and 6). In a particular embodiment, the actuator 142 may be recessed into the axial end. More particularly, the actuator 142 may appear as an unbroken, or nearly unbroken, continuation of the outer surface of the housing 102. That is, the actuator 142 may mimic the look, texture, feel, or material of the adjacent housing 102.

In a non-illustrated embodiment, the housing can include one or more handles for user engagement. The handle may include a textured portion so as to enhance grip therewith. Alternatively, or in addition, the handle may include a material having a high coefficient of friction to prevent slippage when engaged with a human hand.

As illustrated in FIG. 1, the housing 102 may have a varying cross-sectional size or profile. In an embodiment, the housing 102 may have an hourglass type shape. This may enhance operator grip by permitting an operator to grasp a majority of a perimeter of the housing 102.

In a further embodiment, the housing 102 may have a varying shape, such that at a first elevation the housing 102 may have a polygonal cross-sectional profile and at a second elevation the housing 102 may have a different polygonal cross-sectional profile or even an ellipsoidal cross-sectional profile.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the embodiments as listed below.

Embodiment 1. An apparatus for dispensing a liquefied fluid comprising:

a housing;

a main reservoir at least partially disposed within the housing, wherein the main reservoir is adapted to receive a substance;

a heating element adapted to melt the substance into liquefied fluid, a second reservoir in fluid communication with the main reservoir; and a nozzle in fluid communication with the second reservoir, wherein the substance is dispensable from the nozzle as liquefied fluid.

Embodiment 2. An apparatus for dispensing a liquefied fluid comprising:

a housing;

a main reservoir adapted to receive a substance; and a heating element disposed within the housing such that the heating element is adjacent to the main reservoir, wherein the heating element is adapted to melt the substance into liquefied fluid.

Embodiment 3. An apparatus for dispensing a liquefied fluid comprising:

a housing;

a main reservoir at least partially disposed within the housing and adapted to receive a substance;

a heating element positioned to melt the substance into liquefied fluid; and a nozzle in fluid communication with the main reservoir and adapted to atomize the liquefied fluid.

Embodiment 4. A method of dispensing a liquefied fluid comprising:

providing an apparatus having a housing containing a main reservoir, a heating element, and a nozzle;

engaging the heating element such that a substance within the main reservoir forms liquefied fluid; and selectively engaging a control element on the apparatus to dispense liquefied fluid from the nozzle.

Embodiment 5. The apparatus or method according to any one of the preceding embodiments, wherein the apparatus further comprises:

a second reservoir, wherein the main reservoir and second reservoir are in fluid communication with one another.

Embodiment 6. The apparatus or method according to embodiment 5, wherein the main reservoir has a first volume, $V_1$, wherein the second reservoir has a second volume, $V_2$, and wherein the first volume is different from the second volume.

Embodiment 7. The apparatus or method according to embodiment 6, wherein $V_1$ is greater than $V_2$.

Embodiment 8. The apparatus or method according to any one of embodiments 6 and 7, wherein $V_1$ is at least 1.01 $V_2$, such as at least 1.05 $V_2$, at least 1.1 $V_2$, at least 1.25 $V_2$, at least 1.5 $V_2$, at least 1.75 $V_2$, at least 2.0 $V_2$, at least 3 $V_2$, at least 4 $V_2$, at least 5 $V_2$, or even at least 10 $V_2$.

Embodiment 9. The apparatus or method according to any one of embodiments 6-8, wherein $V_1$ is no greater than 100 $V_2$, such as no greater than 75 $V_2$, no greater than 50 $V_2$, or even no greater than 25 $V_2$.

Embodiment 10. The apparatus or method according to any one of embodiments 5-9, wherein the main reservoir and second reservoir are coupled together by a passageway, such as a tube.

Embodiment 11. The apparatus or method according to embodiment 10, wherein the passageway comprises a material different from a material of the main and second reservoirs.

Embodiment 12. The apparatus or method according to any one of embodiments 5-11, wherein the main reservoir is adapted to receive and at least partially melt the substance to form the liquefied fluid.

Embodiment 13. The apparatus or method according to any one of embodiments 5-12, wherein the second reservoir is in fluid communication with a nozzle.

Embodiment 14. The apparatus or method according to any one of embodiments 5-13, wherein the second reservoir is disposed in fluid communication between the main reservoir and a nozzle.

Embodiment 15. The apparatus or method according to any one of embodiments 5-14, wherein the apparatus further comprises:

a pump adapted to generate a fluid flow of the liquefied fluid from the main reservoir to the second reservoir.

Embodiment 16. The apparatus or method according to embodiment 15, wherein the pump is disposed in fluid communication between the main reservoir and the second reservoir.

Embodiment 17. The apparatus or method according to embodiment 15, wherein the second reservoir is disposed in fluid communication between the main reservoir and the pump.

Embodiment 18. The apparatus or method according to any one of embodiments 15-17, wherein the pump is selectively engageable between an on position and an off position.

Embodiment 19. The apparatus or method according to embodiment 18, wherein the pump is selectively engaged in the on position when a volume of the liquefied fluid in the second reservoir is less than a selected value.

Embodiment 20. The apparatus or method according to any one of embodiments 18 and 19, wherein the pump is selectively engaged in the off position when a volume of the liquefied fluid in the second reservoir is greater than or equal to a selected value.

Embodiment 21. The apparatus or method according to any one of embodiments 18-20, wherein selective engagement of the pump between the on and off positions is automatically affected by the logic element.

Embodiment 22. The apparatus or method according to any one of embodiments 15-21, wherein the apparatus further comprises a main sensor disposed in the main reservoir, the main sensor adapted to sense a volume of the liquefied fluid in the main reservoir and transmit a signal of the sensed volume to a logic element which selectively engages the pump between an on position and an off position.

Embodiment 23. The apparatus or method according to any one of embodiments 15-22, wherein the apparatus further comprises a second sensor disposed in the second reservoir, the second sensor adapted to sense a volume of the liquefied fluid in the second reservoir and transmit a signal of the sensed volume to a logic element which selectively engages the pump between an on position and an off position.

Embodiment 24. The apparatus or method according to any one of the preceding embodiments, wherein the main reservoir defines an internal volume, and wherein the main reservoir further comprises:

an outlet adapted to permit flow of liquefied fluid from the internal volume; and a filter disposed between the outlet and an inlet of the main reservoir.

Embodiment 25. The apparatus or method according to embodiment 24, wherein the filter comprises:

a bottom surface comprising at least one aperture;

a first side surface extending from the bottom surface;

a second side surface extending from the bottom surface; or a combination thereof.

Embodiment 26. The apparatus or method according to embodiment 25, wherein the first side surface comprises at least one aperture, wherein the second side surface comprises at least one aperture, or a combination thereof.

Embodiment 27. The apparatus or method according to any one of embodiments 25 and 26, wherein at least one of the at least one apertures has a feature adapted to disrupt surface tension of the liquefied fluid.

Embodiment 28. The apparatus or method according to any one of embodiments 25-27, wherein the first and second side surfaces extend from the bottom surface at a same relative angle, as measured with respect to the bottom surface.

Embodiment 29. The apparatus or method according to any one of embodiments 24-28, wherein the filter is disposed adjacent to the outlet.

Embodiment 30. The apparatus or method according to any one of the preceding embodiments, further comprising a position sensor adapted to detect a relative position or angle of the apparatus.

Embodiment 31. The apparatus or method according to embodiment 30, wherein the position sensor is adapted to terminate or adjust operation of the apparatus when a position or angle of the apparatus is beyond a predetermined threshold.

Embodiment 32. The apparatus or method according to any one of the preceding embodiments, wherein the apparatus further comprises:

a heating element disposed within the housing such that the heating element is adjacent to the main reservoir, wherein the heating element is adapted to melt the substance into liquefied fluid.

Embodiment 33. The apparatus or method according to embodiment 32, wherein the heating element comprises a wrapped coil extending around at least a portion of the main reservoir.

Embodiment 34. The apparatus or method according to any one of embodiments 32 and 33, wherein the heating element is disposed adjacent to a bottom portion of the main reservoir.

Embodiment 35. The apparatus or method according to any one of embodiments 32-34, wherein the heating element is selectively engageable between an on position and an off position.

Embodiment 36. The apparatus or method according to any one of embodiments 32-35, wherein the apparatus further comprises a logic element, and wherein the logic element is adapted to selectively engage the heating element between an on and an off position.

Embodiment 37. The apparatus or method according to any one of embodiments 35 and 36, wherein the heating apparatus is engaged in the on position until a volume of the liquefied fluid in the main reservoir is greater than or equal to a selected value.

Embodiment 38. The apparatus or method according to any one of embodiments 32-37, wherein the heating element extends at least partially along a hose disposed between the main reservoir and a second reservoir.

Embodiment 39. The apparatus or method according to any one of embodiments 32-38, wherein the heating element extends at least partially along a hose disposed between a second reservoir and a nozzle.

Embodiment 40. The apparatus or method according to any one of embodiments 32-39, wherein the heating element is adapted to have a first temperature at a first location along the heating element and a second temperature at a second location along the heating element, and wherein the first temperature is different than the second temperature.

Embodiment 41. The apparatus or method according to any one of embodiments 32-40, wherein the heating element is electrically coupled to a power source, and wherein the power source is disposed within the housing of the apparatus.

Embodiment 42. The apparatus or method according to any one of the preceding embodiments, wherein the apparatus further comprises:

a nozzle adapted to receive and atomize the liquefied fluid.

Embodiment 43. The apparatus or method according to embodiment 42, wherein the nozzle is adapted to atomize the liquefied fluid at a pressure of at least 5 PSI, such as at least 10 PSI, at least 15 PSI, at least 20 PSI, or even at least 25 PSI.

Embodiment 44. The apparatus or method according to any one of embodiments 42 and 43, wherein the nozzle is adapted to produce a spray pattern on a surface, the spray pattern having an average diameter of at least 1 inch, such as at least 2 inches, at least 3 inches, or even at least 4 inches, when the nozzle is activated at a distance of 1 inch from the surface at a pressure of 25 PSI.

Embodiment 45. The apparatus or method according to any one of embodiments 42-44, wherein the liquefied fluid is atomized such that an average fluid particle diameter is less than 400 microns, such as less than 350 microns, less than 300 microns, less than 250 microns, less than 200 microns, less than 150 microns, or even less than 100 microns.

Embodiment 46. The apparatus or method according to any one of embodiments 42-45, wherein a pressure differential, $\Delta P$, of the liquefied fluid passing through the nozzle is less than 5 PSI, such as less than 4 PSI, less than 3 PSI, less than 2 PSI, or even less than 1 PSI, as measured during a continuous interval of dispensing the liquefied fluid for 10 seconds.

Embodiment 47. The apparatus or method according to any one of embodiments 42-46, wherein a pressure differential, $\Delta P$, of the liquefied fluid passing through the nozzle is approximately 0 PSI as measured during a continuous interval of dispensing the liquefied fluid for 10 seconds.

Embodiment 48. The apparatus or method according to any one of embodiments 42-47, wherein the liquefied fluid is atomized through the nozzle upon engagement of an actuator.

Embodiment 49. The apparatus or method according to embodiment 48, wherein the actuator is selectively engageable between an on position and an off position.

Embodiment 50. The apparatus or method according to embodiment 49, wherein fluid flow through the nozzle is prevented when the actuator is in the off position, and wherein continuous fluid flow through the nozzle is permitted when the actuator is in the on position.

Embodiment 51. The apparatus or method according to any one of embodiments 48-50, wherein the actuator is at least partially exposed from the housing, and wherein a user can selectively engage the actuator between the on and off positions.

Embodiment 52. The apparatus or method according to any one of the preceding embodiments, wherein the apparatus further comprises a base, and wherein the housing is engageable with the base.

Embodiment 53. The apparatus or method according to embodiment 52, wherein the base comprises at least one electrical contact, wherein the apparatus comprises at least one electrical contact, and wherein the at least one electrical contact of the apparatus is adapted to electrically couple to the at least one electrical contact of the base and receive an electrical current therefrom.

Embodiment 54. The apparatus or method according to any one of embodiments 52 and 53, wherein the base comprises an alignment feature adapted to align with a complementary alignment feature disposed in the housing of the apparatus.

Embodiment 55. The apparatus or method according to embodiment 54, wherein the alignment feature comprises one of a post or a recess, and wherein the complementary alignment feature comprises the other of the post or the recess.

Embodiment 56. The apparatus or method according to any one of embodiments 52-55, wherein the base is adapted to receive the apparatus such that no portion of the base is disposed radially outside of the housing of the apparatus.

Embodiment 57. The apparatus or method according to any one of embodiments 52-56, wherein the base has a maximum height of less than 4 inches, such as less than 3 inches, or even less than 2 inches.

Embodiment 58. The apparatus or method according to any one of embodiments 52-57, wherein the apparatus further comprises an LED, and wherein a color of the LED is adapted to change when the apparatus is engaged with the base.

Embodiment 59. The apparatus or method according to embodiment 58, wherein the LED is adapted to indicate:

successful engagement between the apparatus and the base;

whether the apparatus is receiving an electrical current from the base; and if a power source within the apparatus is fully charged.

Embodiment 60. The apparatus or method according to any one of embodiments 52-59, wherein the base includes a pressure generating component adapted to impart a pressure to at least one component in the housing.

Embodiment 61. The apparatus or method according to embodiment 60, wherein the base includes a pump adapted to generate a pressure, and wherein the pump is in fluid communication with at least one of the main reservoir, the second reservoir, and the nozzle.

Embodiment 62. The apparatus or method according to any one of the preceding embodiments, wherein the apparatus further comprises a power source disposed at least partially within the housing, and wherein the power source comprises a battery.

Note that not all of the features described above are required, that a portion of a specific feature may not be required, and that one or more features may be provided in addition to those described. Still further, the order in which features are described is not necessarily the order in which the features are installed.

Certain features are, for clarity, described herein in the context of separate embodiments, may also be provided in combination in a single embodiment. Conversely, various features that are, for brevity, described in the context of a single embodiment, may also be provided separately or in any subcombinations.

Benefits, other advantages, and solutions to problems have been described above with regard to specific embodiments, However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or any change may be made without departing from the scope of the disclosure. Accordingly, the disclosure is to be regarded as illustrative rather than restrictive.

The invention claimed is:

1. An apparatus for dispensing a liquefied fluid comprising:

a housing;

a main reservoir at least partially disposed within the housing, wherein the main reservoir is adapted to receive a substance comprising a food product;

a heating element adapted to melt the substance into liquefied fluid, and heat the main reservoir to a temperature of at least 100° F., wherein the heating element comprises at least one of a wrapping coil, a fin, a plate, a film, a sheet, or a resistance heater, a second reservoir in fluid communication with the main reservoir;

a nozzle in fluid communication with the second reservoir, wherein the substance is dispensable from the nozzle as liquefied fluid, wherein the main reservoir has a first volume, $V_1$, wherein the second reservoir has a second volume, $V_2$, and wherein the first volume is larger from the second volume;

a logic element comprising a sensor adapted to selectively engage the heating element between an on and an off position; and a volume detecting element comprising a float adapted to detect a volume of liquefied fluid within the second reservoir and communicate said volume to the logic element.

2. The apparatus of claim 1, wherein the main reservoir and second reservoir are fluidly coupled together by a passageway.

3. The apparatus of claim 1, wherein the second reservoir is in fluid communication with the nozzle, and wherein the second reservoir is disposed between the main reservoir and the nozzle.

4. The apparatus of claim 1, wherein the apparatus further comprises:

a pump adapted to generate a fluid flow of the liquefied fluid from the main reservoir to the second reservoir.

5. The apparatus of claim 4, wherein the pump is in fluid communication with:

the main reservoir;

the second reservoir;

a passageway in fluid communication with the main reservoir;

a passageway in fluid communication with the second reservoir; or a combination thereof.

6. The apparatus of claim 1, wherein the main reservoir defines an internal volume, and wherein the main reservoir further comprises:

an outlet adapted to permit flow of liquefied fluid from the internal volume; and a filter disposed between the outlet and an inlet of the main reservoir.

7. The apparatus of claim 6, wherein the filter comprises:

a bottom surface;

a first side surface extending from the bottom surface;

a second side surface extending from the bottom surface; or a combination thereof, wherein at least one of the bottom surface, the first side surface, and the second side surface comprises at least one aperture.

8. The apparatus of claim 7, wherein the at least one aperture has a feature adapted to disrupt surface tension of the liquefied fluid, wherein the feature comprises aperture sidewalls.

9. The apparatus of claim 1, wherein the heating element comprises the wrapping coil extending around at least a portion of the main reservoir.

10. The apparatus of claim 1, wherein the heating element extends at least partially along a passageway disposed between the second reservoir and the nozzle.

11. The apparatus of claim 1, wherein the nozzle is adapted to produce a spray pattern on a surface, the spray pattern having an average diameter of at least 1 inch when the nozzle is activated at a distance of 1 inch from the surface at a pressure of 25 PSI.

12. The apparatus of claim 1, further comprising a light generating element positioned adjacent to the nozzle and adapted to provide illumination of the liquefied fluid.

13. The apparatus of claim 1, wherein the sensor is a Hall Effect sensor.

14. An apparatus for dispensing a liquefied fluid comprising:

a housing;

a main reservoir adapted to receive a substance comprising a food product;

a nozzle in fluid communication with the main reservoir, wherein the substance is dispensable from the nozzle as liquefied fluid;

a pump adapted to generate a fluid flow of the liquefied fluid from the main reservoir to the nozzle;

a heating element disposed within the housing such that the heating element is adjacent to the main reservoir, wherein the heating element is adapted to melt the substance into liquefied fluid, wherein the heating element comprises at least one of a wrapping coil, a fin, a plate, a film, a sheet, or a resistance heater, wherein the main reservoir defines an internal volume, and wherein the main reservoir further comprises: an outlet adapted to permit flow of liquefied fluid from the internal volume; and a filter disposed between the outlet and an inlet of the main reservoir, wherein the filter comprises a surface comprising at least one aperture comprising a feature adapted to disrupt surface tension of the liquefied fluid, wherein the feature comprises aperture sidewalls;

a second reservoir in fluid communication with the main reservoir;

a logic element comprising a sensor adapted to selectively engage the heating element between an on and an off position; and a volume detecting element comprising a float adapted to detect a volume of liquefied fluid within the second reservoir and communicate said volume to the logic element.

15. The apparatus of claim 14, further comprising a position sensor adapted to detect a relative position or angle of the apparatus.

16. The apparatus of claim 15, wherein the position sensor is adapted to terminate or adjust operation of the apparatus when a position or angle of the apparatus is beyond a predetermined threshold.

17. The apparatus of claim 14, wherein the heating element comprises the wrapping coil extending around at least a portion of the main reservoir.

18. The apparatus of claim 14, wherein the heating element is adapted to have a first temperature at a first location along the heating element and a second temperature at a second location along the heating element, and wherein the first temperature is different than the second temperature.

* * * * *